US005460324A

United States Patent [19]

Vinther

[11] Patent Number: 5,460,324

[45] Date of Patent: Oct. 24, 1995

[54] OPEN CONTAINER OR DRINKING CUP, COMPACT PREFOLDED

[75] Inventor: Knud Vinther, Solbjerg, Denmark

[73] Assignee: All-Ways APS, Solbjerg, Denmark

[21] Appl. No.: 292,495

[22] Filed: Aug. 18, 1994

Related U.S. Application Data

[63] Continuation of PCT/DK93/00043, Feb. 5, 1993.

[30] Foreign Application Priority Data

Feb. 20, 1992 [DK] Denmark ..... 0216/92

[51] Int. Cl.[6] ..... B65D 3/28; B65D 5/36

[52] U.S. Cl. ..... 229/405; 229/117.05; 229/117.12; 229/402

[58] Field of Search ..... 229/1.5 B, 4.5, 229/117.05, 117.12, 402, 405

[56] References Cited

U.S. PATENT DOCUMENTS

| | | | |
|---|---|---|---|
| 1,002,537 | 9/1911 | Neff | 229/1.5 B |
| 1,369,634 | 2/1921 | Don | 229/1.5 B |
| 1,478,838 | 12/1923 | Reifsnyder | 229/1.5 B |
| 1,514,034 | 11/1924 | Carr | 229/1.5 B |
| 1,690,586 | 11/1928 | Main | 229/117.05 |
| 1,985,111 | 12/1934 | Shofer et al. | 229/117.05 |
| 3,251,533 | 5/1966 | Cohen . | |
| 4,094,457 | 6/1978 | Spillson | 229/1.5 B |
| 4,391,366 | 7/1983 | Hirata . | |
| 4,711,390 | 12/1987 | Andrews et al. . | |
| 4,792,086 | 12/1988 | Chen | 229/1.5 B |
| 4,854,474 | 8/1989 | Murray et al. | 229/1.5 B |
| 4,867,374 | 9/1989 | Murray et al. | 229/1.5 B |
| 5,062,527 | 11/1991 | Westerman . | |
| 5,301,870 | 4/1994 | Smith et al. | 229/1.5 B |

FOREIGN PATENT DOCUMENTS

| | | |
|---|---|---|
| 10290356 | 4/1990 | European Pat. Off. . |
| 12848879 | 5/1980 | Germany . |
| 12907494 | 8/1980 | Germany . |

OTHER PUBLICATIONS

Patent Abstracts of Japan, vol. 13, No. 515, C-655, abstract of JP,A,1-207011 (Isao Hirata), 21 Aug. 1989.

*Primary Examiner*—Gary E. Elkins
*Attorney, Agent, or Firm*—Ladas & Parry

[57] ABSTRACT

A cup is made from sheet material. The cup has two opposite side sections for forming a cylinder with one of a gutter-like and spout-like shape in an open state of the cup, a rectangular including square bottom for serving as a base for the cup in the open state of the cup, and folding lines in the side sections that form sides and bases of two isosceles triangles. The folding lines that form the bases of the two isosceles triangles form two of four edges of the bottom. A central folding line in the bottom is parallel with the other two of the four edges of the bottom and runs along a center line of the bottom, connects to the folding lines of the bases of the two isosceles triangles and continues up along the perpendicular of the two isosceles triangles and the side sections to a rim of the side sections and cup. This divides the side sections into pairwise congruent surfaces with insides that bear upon each other when the cup is in a collapsed state.

17 Claims, 3 Drawing Sheets

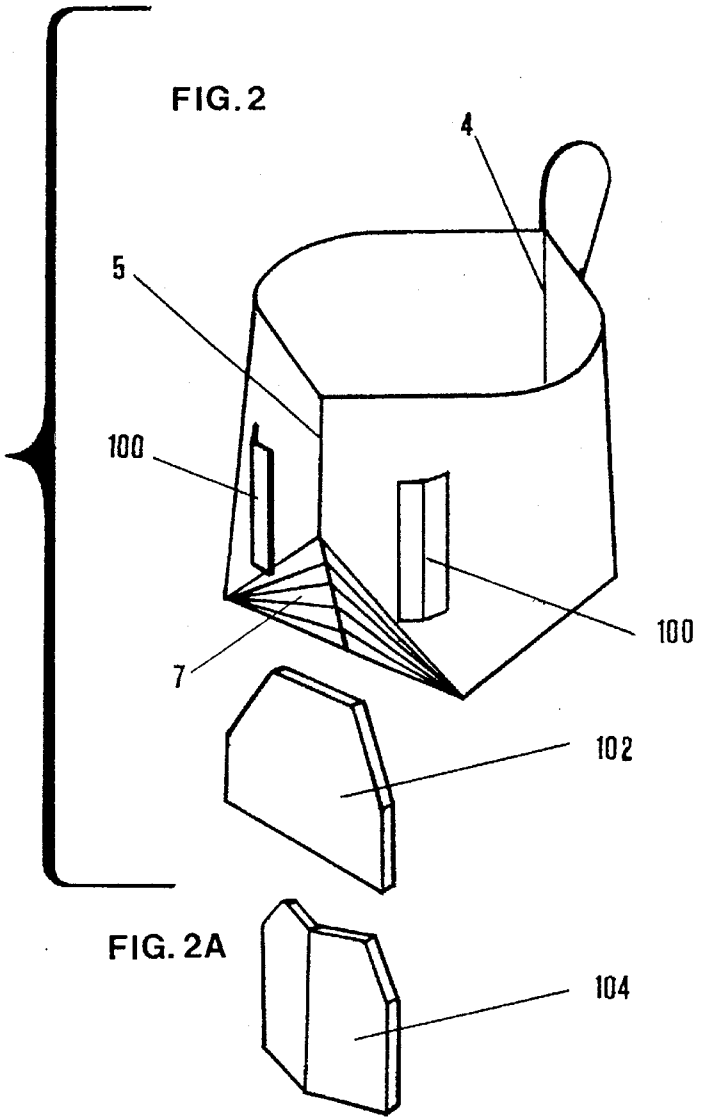
FIG. 2
FIG. 2A
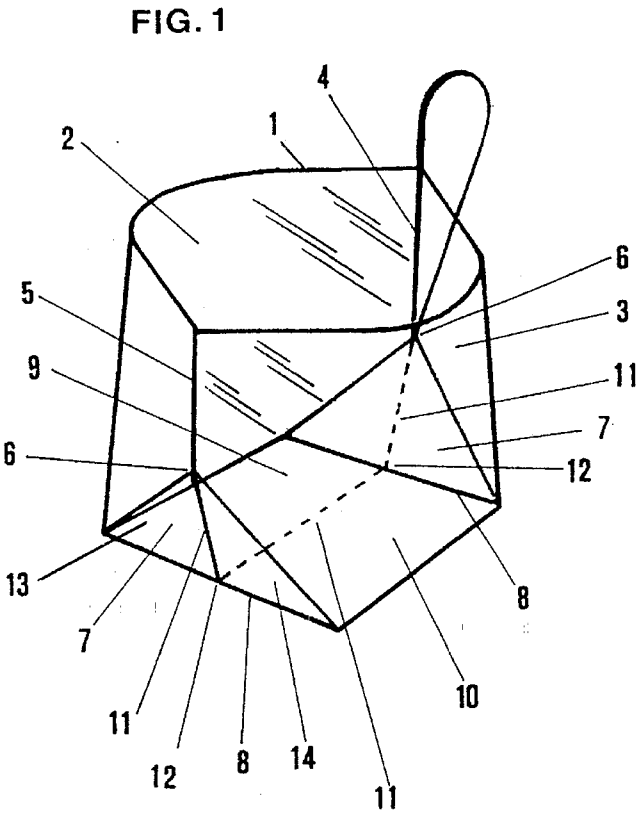
FIG. 1

OPEN CONTAINER OR DRINKING CUP, COMPACT PREFOLDED

This is a continuation of PCT/DK93/00043, filed Feb. 5, 1993.

BACKGROUND OF THE INVENTION

The invention concerns a container or drinking cup the side sections of which form a cylinder and, more particularly , the same formed in one piece with a square or rectangular bottom which, in addition, serves as a base for the cup.

The structures mentioned heretofore shall be referred to hereinafter as a cup. A cup with a cylinder of four side sections may be formed with a rectangular folding bottom, as is generally known and for example described in U.S. Pat. No. 4,711,390. It enables the user to handle the cup in flat form when the cup is not in use. Two opposite sides of the cup's four side sections have folding lines which form the sides of isosceles triangles with base lines that in the open position of the cup, form two of the four edges at the bottom. At the bottom, parallel with the other two edges of the bottom, there is a folding line running along the centre line of the bottom and connecting the base lines of the two triangles. This folding line continues up along the perpendiculars of the two triangles, such that the two isosceles triangles are divided into two triangles with angles of 45° each. The folding line continues on from the two triangles up to the rim of the cup, thus dividing the two opposite sides into pairwise congruent surfaces the insides of which can bear upon each other when the bottom is folded into the inside of the cup around the central folding line, whereby the insides of the other two side sections of the cup, which are parallel to the central folding line, are made to bear upon each other by parallel displacement of the latter two sides. Such a cup is primarily intended to contain liquid or frosted liquid and viscous or damp substances, for which reason the cup material is sealed, i.e. manufactured in a material or with an inside surface which is resistant to the contents of the cup. The cup is meant to be disposable after use, for which reason the material for the construction of the cup has a relatively short lifetime, such as vacuum-moulded or injection-moulded plastic, or cardboard or carton the inside surface of which may be protected by a waterproof material, such as pasted plastic film, wax or varnish.

The known cups of the type with the bottom specified above have four side sections connected to one another at right-angled corners, and the top contour of the cup forms a square opening unsuitable for use in drinking cups, which are usually shaped with circular or polygonal, ring-shaped openings, which both stabilize the shape of the cylinder and additionally form gutter-shaped or spout-shaped structures which collect the liquid in a controlled flow over the rim of the cup when the opening of the cup is tipped from a horizontal to an inclined position. Cups with four side sections as described above are therefore of another type than cups as specified in accordance with this invention, and such cups are often also designed with a closure at the top or with a lid which stabilizes the cylinder of the cup, so that the cup appears rigid and stable because the position of the sides relative to one another is fixed by the closure above. Cups of this type, with four side sections, are only mentioned here because such cups are designed with a folding bottom of a type which is also used for the invention specified here, of which the other modes of functioning are new, while the mode of functioning of the known folding bottom is used in a new way in this invention, for which reason the state of the art is represented by disposable drinking cups in a permanently open form.

The cups generally known are mainly manufactured in flexible materials such as thermoplastics or carton, for which reason various bends in the material are incorporated resulting in a certain rigidity in the sides, bottom and opening, intended to ensure that the contents of the cup do not unintentionally flow over the upper edges of the cup if the latter is subjected to external pressure which might otherwise deform it, whereby the contents would be pressed out over the top edges of the cup. The known cups are typically furnished with a circular opening above, reinforced with a folded bead all the way round, which provides good protection against the above-mentioned pressure. In practice no cups are known with a square opening above, inasmuch as external pressure in that case would have the result that the four right angles inside the square opening would be deformed such that two diagonally opposite angles in the square opening would become greater than 90°, while the other two angles would become less than 90°, whereby such a cup with liquid contents would be particularly unstable to handle, and would lack the necessary gutter-shaped or spout-shaped structure which a drinking cup must have. The cups generally known are given their final shape during manufacture. Many of these cups are therefore formed with a conical cylinder allowing the cups to be stored inside one another. Such cups may be manufactured in plastic or carton. Other cups of cardboard or carton are furnished with a cylinder which typically has three, four or more straight side sections. Such cups, which are intended to contain liquid, are furnished with a stabilizing closure above. No cups are thus known with a stable opening above, consisting of curved edges, and which are further designed with a folding bottom of the above-mentioned type. Drinking cups with a permanently open form further pose particular problems in use of an ergonomic, hygienic and aesthetic nature. These problems and the way of remedying them will be further described and related to the cup as specified in accordance with the invention.

Summary of the Invention

The cup as specified in accordance with the invention is opened or collapsed into a flat form under the influence of a distinctive spring-like effect which keeps the cup fixed in an open, rigid position during use and also keeps it approximately flat and collapsed in a closed position when it is not filled with contents. When the cup is unfolded, the two side sections of the cup are pressed apart and deformed into mirror-inverted, curved side sections under the action of a spring-like effect which renders the opening of the cup rigid and stable. At the same time the side sections thus held in tension have a reinforcing effect on the spring-like effect of the extended bottom, whereby the bottom is fixed in its open position, and thus holds the two side sections in tension in the open position of the cup. The weight of the contents of the cup will furthermore exert pressure on the inside of the bottom and sides and will thus help to render the open form of the cup even more stable and strong than the open empty cup. The combination of the known technique of the folding bottom with a cup with only two side sections thus creates a new effect, inasmuch as the opposing tensions of the bottom and sides act upon each other such that the open, unfolded cup has approximately the same stability and tension features as a vacuum-moulded disposable cup in plastic with a permanently open form.

Since the cup as specified in accordance with the invention is folded such that the two insides of the cup bear upon each other, this form presents only a minimum of storage and transport problems compared with cups with a permanently open form. Furthermore, the transport of individual cups which are stored together with other items, for example in suitcases and baskets, will not cause damage to the cups, as is the case with disposable drinking cups manufactured in plastic. Such cups can easily be torn or broken by external pressure on the thin cylinder section of the cup.

The folded position of the open cup further means that dust and bacteria will not gather inside the cup before use. This can be the case with the cups generally known, if they are not stored in a closed vending machine. The cup as specified in accordance with the invention can therefore minimize the spread of infection in hospitals and in other places where there is a particularly high risk of the spread of infectious diseases and other infections.

As definitive proof that a cup has not been used, it is further sealed along a section of the closed aperture of the cup in folded position, where the seal may consist of a glued label stretching from one of the sides of the cup over the closed aperture of the cup to the other side, or the insides of the cup may be discontinuously glued or welded along the edge, or the cup may be furnished with a seal which consists of a detachable edge which is in one piece with the sides of the cup and which can be torn or cut off from it along a perforated or punched line, inasmuch as the actual detachable edge, consisting of parts of the two sides of the cup, is glued or welded together. The user can thus be sure that the cup has not already been used, and the said seal also means that the insides of the cup lie flat against each other and the cup takes up as little space as possible and ensures that no dust or other particles can penetrate into the cup.

It is appropriate that the cup is furnished with a stable bottom, and if the cup is to be used for drinking, that it is further furnished with a suitably large handle. The design of the cup as specified in accordance with the invention is not restricted to the use of the above-mentioned conical cylinder which is characteristic of ordinary disposable drinking cups, where in addition any handle must be so designed that the cups can be stored inside one another. This means that the known cups are not as stable in use, inasmuch as the conical cylinder means that the circumference and area of the bottom are less than those of the top opening of the cup, which can thus be knocked over if there is only a little of the contents of the cup left, since the known disposable cups of this type do not have a particularly high specific gravity, unlike for example permanent drinking vessels of glass or porcelain, which can easily have a conical cylinder shape.

With the known cups there are in addition production considerations which mean that the cylinder and handle must have a slightly conical form to ease removal from the mould on or in which the cup is manufactured.

The plastic cups generally known are either moulded or vacuum-moulded and the raw material cannot of course be given texts, patterns or pictures, for which reason the finished cups are printed with such motifs in a screen printing process. For cups as specified in accordance with this invention one can instead use an offset printing technique, which is cheaper, with a higher print quality, and if the cups are manufactured in carton or plastic foil in sheets or lengths, it will be possible to mass-produce offset-printed motifs of high quality at very competitive prices, which, in combination with the distinctive flat form of the cup, will provide a larger exposure surface for the printed motif than is possible with the known cups with circular or right-angled side sections, which must be turned round if one is to read or see a motif or text of a similar size. In its folded state, the cup as specified in accordance with the invention has a very large visual exposure surface which makes the cup particularly suitable for printed messages of a promotional nature, which in combination with the high printing quality and the low production price of the cup, makes the cup as specified in accordance with the invention a new and effective advertising medium.

The new effects of the cup as specified in the application are achieved by using the already-known technique in the folding bottom with a different type of cylinder, characterized by the fact that the cup (1) is furnished with a total of two side sections (2, 3), the insides of which in the folded state of the cup bear upon each other, discontinuously glued or welded along the rim of the opening of the cup, or along certain flaps (15) which form one piece with the sides (2, 3) and which are intended for detachment along perforated lines (16), inasmuch as part of the said flaps is retained on the cup, folded out along the folding lines (17) such that the insides of the flaps are turned out and serve as a contact surface for the lips of the mouth while the user drinks from the cup, inasmuch as the side sections (2, 3) in the open state of the cup are held in tension in mirror-inverted and essentially congruent convex curves or rimmed sections which together form curves held in tension between the two folding lines (4, 5), the said curves or sections additionally forming gutter-shaped or spout-shaped structures for the emptying of the contents of the cup when the opening of the cup is tilted from a horizontal to an inclined position.

The cup is opened by pressure and counterpressure on the edges 4 and 5 respectively or by pulling the sides 2 and 3 apart as in FIG. 1, inasmuch as the discontinuous seal at the middle of sides 2 and 3 is first broken, for example by a fingernail inserted between the collapsed sides 2 and 3 at the edge 5 and moved in towards the middle of the sides 2 and 3 where these are discontinuously glued or welded together. The cup then jumps into open position, and the distance between the said edges 4 and 5 is decreased, with the result that the sides 2 and 3 are held in spring-like tension in mirror-inverted convex curves, making the opening of the cup rigid and stable, inasmuch as the said sides, which are not in tension in the collapsed and closed state of the cup, have the effect of two tension-inducing leaf springs which are fixed in their open state by the action of the slightly deformed and sprung curve of the sides, which is achieved by exerting the aforementioned pressure and counterpressure on the edges 4 and 5, or by pulling the sides 2 and 3 apart. To make the sealing of the cup easier to break, and at the same time to create visual proof that the seal has been broken, the cup may be furnished with a detachable edge or some flaps 15 as in Drawing No. 3, where such a detachable edge strip can also form a cleat, thus preventing the distribution of loose parts to the cup. The detachable edge or seal 15 is torn off along the perforated line 16. As long as the seal 15 has not been torn off, the user has definitive visual proof that the cup is unused. After the seal has been detached, two flaps along the edge of the opening of the cup are retained, inasmuch as the formerly protected insides of the flaps are folded along the folding line 17, by which means the user can be sure that the contact surface for the lips of the mouth is absolutely clean, even if the cup has been stored in conditions that could entail that the outsides of the cup are covered with dust or other particles.

A special embodiment of the cup as specified in accordance with the invention is to furnish the cup with angled guides on each side of the folding lines 4 and 5 as in FIG. 2. In the open position of the cup these guides form brackets for the introduction of a flat cleat over the end of the guides.

This locks the cup more stably in open position, while the shape of the cleat at the surface helps to shape the opening of the cup. This gives greater rigidity and stability to the cylinder of the cup, while the cleat helps to prevent accidents with the cup where the cup could be made to collapse before the contents were used and the contents would be pressed out over the rim of the cup.

Some embodiments of the invention give the cup a smoother transition from the closed to the open position. This avoids leakage in a cup mode from carton pasted with plastic film, which could otherwise be deformed such that the plastic coating could be torn and the cup leak. It has emerged that if one adds three identical triangles 7 with folding lines within, as shown in FIGS. 2 and 5, the centre line 11 in the erect state virtually rolls out through the perpendiculars of the said triangles, while the points 12 are displaced in stages until the straight centre line reaches the points 6, making the centre line a straight line. This effect takes place almost automatically, as a result of the spring-like action of the sides triggered by the folding of the cup. Undulating folding lines will enhance said automatic effect, inasmuch as the undulating folding lines will be forced more closely together by the opening and closing of the cup and will thus have a spring-like, reinforcing effect on the said action.

A particularly important embodiment of the invention is cut out or punched out in one piece without joints from a plane sheet or length of cardboard, carton or plastic sheet with the folding lines 18 as in FIG. 5. During the assembly of the cup, certain tabs 21 and 22 as in FIG. 6 arise, where the insides of the tabs are folded around the said lines 18. The edges of the said tabs are flush with the rim of the cup when the cup is assembled, rendering it waterproof if the surface of the material, or at least the inside surface, is proof against the contents which the cup is meant to contain. The tabs are bent back around the outside of the cylinder and may form a handle consisting of the two tabs 21 at one end of the cup, and at the other end of the cup the points of the tabs 22 overlap each other inside and under the bent-back flap 24, which is bent down over the tabs and fixes these in position without any gluing or welding of the material. The flap 23 has a similar function, but is further furnished with a slot which is moved down over the parts of the tabs 21 which form the handle, thus fixing the said tabs in a stable assembly. The assembled and folded cup of this type appears in FIG. 4.

A cleat can fix the cup in its open position. The cup has a naturally-formed space for the cleat between the tabs 21 and 22 and the outside of the cup at the outer surface of the cylinder.

In one embodiment of the cup, the cleat forms a permanent part of the sides of the cup, inasmuch as the cleat consists of a part of the flaps 15, which is detached when the seal of the cup is broken. Such a cleat consists of two congruent tabs which are permanent parts of the sheet or length of material from which the cup is cut or punched out, inasmuch as the two tabs are glued or welded together above the perforated tearing line when the cup is assembled as shown in FIG. 3.

The cup as specified in Claim 9 is particularly suitable for informative purposes and for messages of a promotional nature, inasmuch as patterns, symbols, texts and pictures may be applied to the cup by means of already-known printing methods such as offset or screen printing. The print is applied to the plane sheet or lengths before or after the cups are cut or punched from it, and before the cups are assembled, or one may choose to apply the print after the assembly of the cups, when the sides of the cups are completely flat in the collapsed position of the cups and thus form a good surface for the application of the print.

In use, the two curved sides of the open cup offer wide visual exposure surfaces which can be viewed without turning the cup. These exposure surfaces are particularly easy to view when the user receives the cup in collapsed form.

The cup is therefore in addition a new medium for advertisements and other messages. Not least when the embodiment of the invention is a drinking cup, the cup can be used as a quick, cheap means of contact with many people, inasmuch as the cup can further be distributed in ordinary postal envelopes.

BRIEF DESCRIPTION OF THE DRAWING

The invention is explained in more detail in the following with references to the drawings, where FIG. 1 shows a preferred embodiment of a drinking cup as specified in accordance with this invention, manufactured in a transparent plastic material.

FIG. 2 shows a similar cup, but in an opaque material, furnished with angled guides which allow for the introduction of a cleat (shown exploded).

FIG. 2A shows an alternative cleat for the embodiment of FIG. 2.

DESCRIPTION OF EMBODIMENTS

Figure 5:
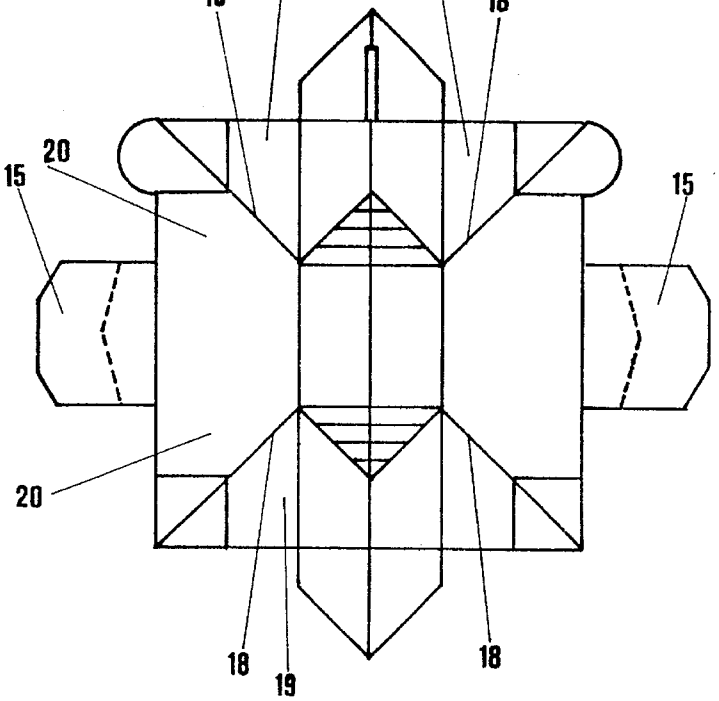
FIG. 5 shows the cup as shown in FIGS. 3 and 4 as it looks on the sheet or length of material after cutting or punching out.

FIG. 1 shows a cup in an open position after a discontinuous seal along the rim of the cup has been broken. The cup is injection-moulded or vacuum-moulded in a transparent plastic material, and the folding lines 4, 5, 8 and 11 are stamped in the material as V-shaped grooves. The sides 2 and 3 of the cup may be thicker along the opening of the cup than the other surfaces of the cup, which will enhance the spring-like features of the sides in the open position of the cup. The points 6 and 12 are intersection points of the said folding lines.

FIG. 2 shows a similar injection-moulded cup, but in an opaque material shaped with angled guides 100 on each side of the folding lines 4 and 5. These guides have longitudinal openings facing each other, such that a cleat 102, 104 (FIG. 2A) may be introduced over the end of the angled guides at the bottom of the cup. The cleat 102 shown in FIG. 2 has a straight surface, which gives the cup a special curved opening. An alternative cleat is slightly angled around its axis of symmetry, so that 104 (FIG. 2A) the shape of the cleat follows the natural open shape of the cup over the ends at the folding lines 4 and 5. The triangles 7 are formed with three isosceles triangles within them along the folding lines, facilitating a smoother transition from the open form of the cup to its collapsed position, such that the form with the triangles 7 is particularly applicable for manufacturing the cup from a particularly stiff material.

Figure 3:
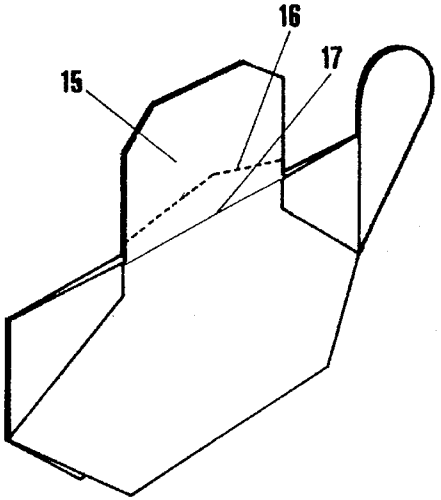
FIG. 3 shows a similar cup which may be manufactured by cutting or punching out from a sheet or length of cardboard, carton or plastic, inasmuch as the cleat is in one piece with the cup on the sheet.
Figure 4:
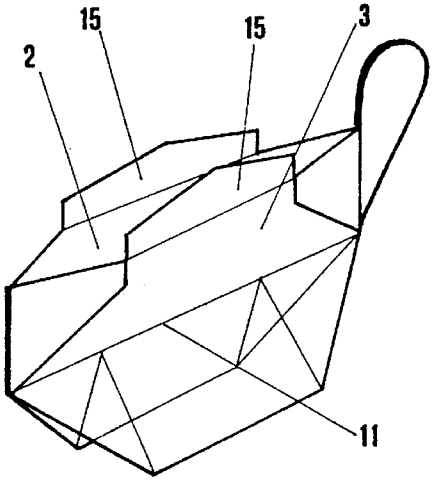
FIG. 4 shows a cup corresponding to the cup in FIG. 3, but with the cleat detached along a perforated line, after which the cup can be opened.

FIGS. 3 and 4 show a cup in a collapsed position as cut or punched from a sheet or length of cardboard, carton or plastic. The cup as shown in FIG. 3 has a cleat which is in one piece with the sides 2 and 3 of the cup. The cleat can be detached along a perforated line 16, leaving flaps 15, which can be seen in FIG. 4. The flaps are bent back along folding lines 17 on each of the sides 2 and 3, whereby the clean insides of the flaps are turned outwards and for contact by the lips of a user's mouth when the user drinks from the cup. As can be seen in FIG. 4, the centre line 11 runs in the erect position between the aforementioned intersection points 6, inasmuch as the centre line thus divides the aforementioned triangles 7 and the bottom of the cup as described above.

Figure 6:
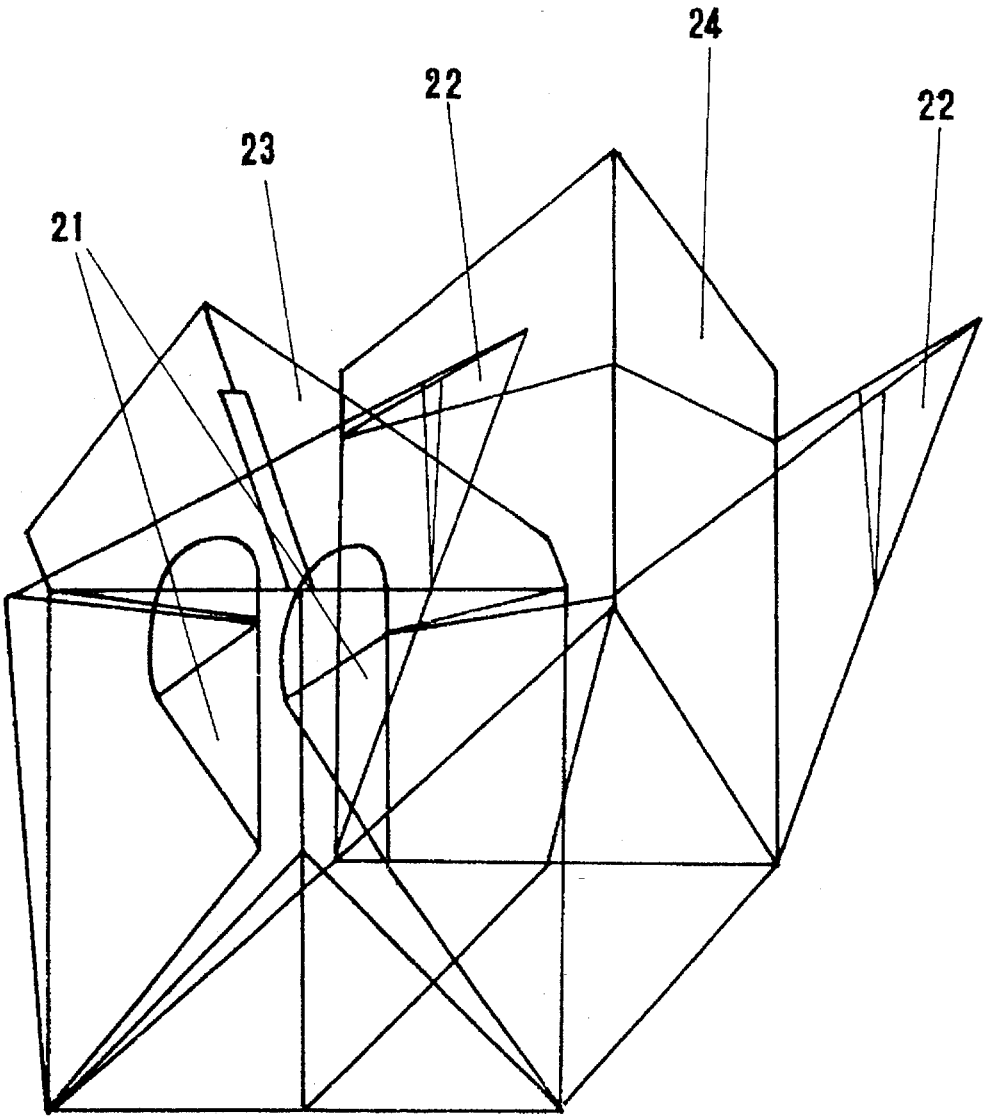
FIG. 6 shows the cup as in FIGS. 3–5, during assembly into an open cup.

FIG. 5 shows the cut or punched cup in the unassembled state, with the aforementioned folding lines of the cup marked off on the sheet along with the folding lines 18 peculiar to the invention as in FIG. 5, around which the areas 19 and 20 shown in the figure are bent into tabs which run along the outside surfaces of the cup in the assembled state of the cup, inasmuch as the edges of the tabs are flush with the rim of the cup. The two parts of the flaps 15 of the cup which are above the broken line, and which form a cleat, will be glued or welded together into one cleat. The aforementioned triangles 7 are furnished on the sheet with folding lines which run parallel with the base lines of the triangles, which gives the cup a smoother transition from the closed to the open position. Also indicated on the sheet are the two lugs which form the handle of the cup, as are the flaps 23 and 24 as in FIG. 6. FIG. 6 shows the cup as in FIG. 5 during assembly, but without the flaps 15 shown in FIG. 5. It can be seen that the tabs 21 and 22 are flush with the rim of the cup when open, which makes the cup waterproof, inasmuch as the liquid in the cup will only run out into the said tabs without running over the edge of the tabs, since the liquid level in the cup will always lie below the edges of the tabs. The flaps 23 and 24 are seen before they are turned down around the outside of the cylinder of the cup, thus fixing the tabs 21 and 22 in against the outer surface of the cylinder of the cup. The flap 23 is embodied with a cut or punch slot through which the two parts of the cup which form the handle are inserted when the flap is turned down over the tabs 21, locking the handle of the cup in a stable position.

I claim:

1. A cup comprising:

sheet material having two opposite side sections (2, 3) for forming a cylinder with one of a gutter-like and spout-like shape in an open state of the cup, a rectangular including square bottom (9, 10) for serving as a base for the cup in the open state of the cup, folding lines in the side sections that form sides and bases of two isosceles triangles (7), the folding lines (8) that form the bases of the two isoscles triangles (7) forming two of four edges of the bottom (9, 10), a central folding line (11) in the bottom (9, 10) parallel with the other two of the four edges of the bottom (9, 10) and running along a centre line of the bottom (9, 10) and connecting to the folding lines (8) of the bases of the two isosceles triangles at intersections (12), the central folding line (11) continuing up along the perpendicular of the two isosceles triangles such that the two isosceles triangles are divided into further triangles each with two angles of 45°, further folding lines (4, 5) respectively continuing up the side sections (2, 3) from the central folding line and apices of the two isosceles triangles to a rim of the side sections and cup, thus dividing the side sections into pairwise congruent surfaces insides of which bear upon each other when the cup is in a collapsed state with the bottom (9, 10) folded inside of the cup around the central folding line (11), and discontinuous gluing or welding along the rim of the cup for holding the cup in the collapsed state until opened, whereby, in the open state of the cup, the side sections are held in tension with each other and in virtually congruent, mirror-inverter convex curves between the further folding lines (4, 5), the curves forming the gutter-like or spout-like shaped for emptying contents of the cup, wherein the sheet material is vacuum-moulded or injection-moulded plastic, cardboard or carton.

2. The cup in accordance with claim 1, and further comprising:

angled guides (100) respectively on the side sections, the angled guides having longitudinal openings that face each other for forming a bracket for the insertion of a cleat.

3. The cup in accordance with claim 1, wherein:

the two isosceles triangles (7) are identical and each contain several more folding lines which run parallel with the folding lines (8) of the bases of the two isosceles triangles (7) and connect the sides of the two isosceles triangles (7).

4. The cup in accordance with claim 1, wherein:

the two isosceles triangles (7) are identical and each contain several more folding lines that define more isosceles triangles, the more isosceles triangles having the same bases as defined by the folding lines (8) of the respective two isosceles triangles and perpendiculars that become successively smaller toward the bases of the two isosceles triangles.

5. The cup in accordance with claim 1, wherein the side sections (2, 3) are printed while their insides bear upon each other in the collapsed state of the cup.

6. The cup in accordance with claim 2, wherein:

the two isosceles triangles (7) are identical and each contain several more folding lines which run parallel with the folding lines (8) of the bases of the two isosceles triangles (7) and connect the sides of the two isosceles triangles (7).

7. The cup in accordance with claim 2, wherein:

the two isosceles triangles (7) are identical and each contain several more folding lines that define more isosceles triangles, the more isosceles triangles having the same bases as defined by the folding lines (8) of the respective two isosceles triangles and perpendiculars that become successively smaller toward the respective bases of the two isosceles triangles.

8. A cup, comprising:

sheet material having two opposite side sections (2, 3) for forming a cylinder with one of a gutter-like and spout-like shape in an open state of the cup, a rectangular including square bottom (9, 10) for serving as a base for the cup in the open state of the cup, folding lines in the side sections that form sides and bases of two isosceles triangles (7), the folding lines (8) that form the bases of the two isosceles triangles forming two of four edges of the bottom (9, 10), a central folding line (11) in the bottom (9, 10) parallel with the other two of the four edges of the bottom and running along a centre line of the bottom (9, 10) and connecting to the folding lines (8) of the bases of the two isosceles triangles at intersections (12), the central folding line (11) continuing up along the perpendicular of the two isosceles triangles such that the two isosceles triangles are divided into further triangles each with two angles of 45°, further folding lines (4, 5) respectively continuing up the side sections (2, 3) from the central folding line and apices of the two isosceles triangles to a rim of the side sections and cup, thus dividing the side sections into pairwise congruent surfaces insides of which bear upon each other when the cup is in a collapsed state with the bottom (9, 10) folded inside of the cup around the central folding line (11), flaps (15) respectively extending from flap-folding lines (17) on the rim of the side sections and cup, each of the flaps having a perforated line (16) for detaching a portion of the flap on an opposite side of the flap from the side sections and flap-folding lines, whereby parts of the flaps that are retained can be bent over along the flap-folding lines (17) such that insides of the retained parts of the flaps are turned outwards to serve as contact surfaces for lips of a user drinking from the cup, and discontinuous gluing or welding on the flaps for holding the cup in the collapsed state until opened, whereby, in the open state of the cup, the side sections are held in tension with each other and in virtually congruent, mirror-inverted convex curves between the further folding lines (4, 5), the curves forming the gutter-like or spout-like shape for emptying contents of the cup, wherein the sheet material is vacuum-moulded or injection-moulded plastic, cardboard or carton.

9. The cup in accordance with claim 8, and further comprising:

angled guides (100) respectively on the side sections, the angled guides having longitudinal openings that face each other for forming a bracket for the insertion of a cleat.

10. The cup in accordance with claim 8, wherein:

the two isosceles triangles (7) are identical and each contain several more folding lines which run parallel with the folding lines (8) of the bases of the two isosceles triangles (7) and connect the sides of the two isosceles triangles (7).

11. The cup in accordance with claim 9, wherein:

the two isosceles triangles (7) are identical and each contain several more folding lines which run parallel with the folding lines (8) of the bases of the two isosceles triangles (7) and connect the sides of the two isosceles triangles (7).

12. The cup in accordance with claim 8, wherein:

the two isosceles triangles (7) are identical and each contain several more folding lines that define more isosceles triangles, the more isosceles triangles having the same bases as defined by the folding lines (8) of the respective two isosceles triangles and perpendiculars that become successively smaller toward the respective bases of the two isosceles triangles.

13. The cup in accordance with claim 9, wherein:

the two isosceles triangles (7) are identical and each contain several more folding lines that define more isosceles triangles, the more isosceles triangles having the same bases as defined by the folding lines (8) of the respective two isosceles triangles and perpendiculars that become successively smaller toward the respective bases of the two isosceles triangles.

14. The cup in accordance with claim 8, wherein the side sections (2, 3) are printed while their insides bear upon each other in the collapsed state of the cup.

15. The cup in accordance with claim 9, wherein the portion of at least one of the flaps that is detached is the cleat.

16. The cup in accordance with claim 11, wherein the portion of at least one of the flaps that is detached is the cleat.

17. The cup in accordance with claim 13, wherein the portion of at least one of the flaps that is detached is the cleat.

* * * * *